US007389765B2

(12) United States Patent
Ikeda

(10) Patent No.: US 7,389,765 B2
(45) Date of Patent: Jun. 24, 2008

(54) ELECTRICALLY CONTROLLED THROTTLE APPARATUS

(75) Inventor: Tsutomu Ikeda, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 11/783,716

(22) Filed: Apr. 11, 2007

(65) Prior Publication Data

US 2007/0272206 A1 Nov. 29, 2007

(30) Foreign Application Priority Data

May 23, 2006 (JP) ..... 2006-142848

(51) Int. Cl.
*F02D 11/10* (2006.01)

(52) U.S. Cl. ..... 123/399; 73/118.1; 123/339.14; 324/207.25

(58) Field of Classification Search ..... 123/339.14, 123/361, 396, 399; 73/118.1; 324/207.25
See application file for complete search history.

(56) References Cited

U.S. PATENT DOCUMENTS 5,889,400 A * 3/1999 Nakazawa ..... 324/207.25
2002/0089324 A1* 7/2002 Miyata et al. ..... 324/207.25
2005/0022785 A1* 2/2005 Kurita et al. ..... 123/399

FOREIGN PATENT DOCUMENTS

JP A-2003-172157 6/2003

* cited by examiner

*Primary Examiner*—T. M Argenbright
(74) *Attorney, Agent, or Firm*—Oliff & Berridge, PLC

(57) ABSTRACT

An electrically controlled throttle apparatus comprises a throttle valve for controlling an amount of intake air to be supplied to an internal combustion engine; a throttle body which houses the throttle valve; a motor for driving the throttle valve; and a throttle sensor for detecting an opening degree of the throttle valve. The throttle sensor is a magnetic resistance element for detecting a change in direction of a magnetic field. The direction of the measured magnetic field of the throttle sensor when the throttle valve is in an opening learning reference position used as a criterion by the throttle sensor is the same as a direction of a leakage magnetic field of from the motor.

9 Claims, 8 Drawing Sheets

IDLING OPENING(FULL CLOSE)

OPENER OPENING

FULL OPEN

ELECTRICALLY CONTROLLED THROTTLE APPARATUS

BACKGROUND OF THE INVENTION

1. Field of the Invention

The present invention relates to an electrically controlled throttle apparatus for controlling an amount of intake air to be supplied to an internal combustion engine.

2. Description of Related Art

A conventional electrically controlled throttle apparatus comprises a throttle body forming an intake passage, a throttle valve for opening/closing the intake passage, a motor for driving the throttle valve, and a throttle sensor for detecting an actual opening degree of the throttle valve. The rotation of the motor is transmitted to the throttle valve through a speed reduction mechanism to thereby drive (open/close) the throttle valve.

To be more specific, the conventional electrically controlled throttle apparatus is arranged to detect the actual opening degree of the throttle valve by use of a throttle sensor, and drive the motor to control the opening/closing operation of the throttle valve so that the detected actual opening degree reaches a target opening degree. Some of the throttle sensors use hall elements. This type of throttle sensor is configured to detect the actual opening degree of the throttle valve by detecting changes in magnetic flux density caused by the opening/closing of the throttle valve (the rotation of a throttle shaft).

However, the electrically controlled throttle apparatuses, including the above mentioned one, which comprise the throttle sensor using the hall element sometimes could not control the amount of intake air with accuracy. This is because the throttle sensor tends to be influenced by a magnetic force leaking out of the motor and therefore cannot accurately detect the changes in magnetic flux density caused by the opening/closing of the throttle valve (the rotation of the throttle shaft). Hence, the output of the throttle sensor may change improperly. When the motor operates, furthermore, a current passing through the motor changes and thus the strength of the magnetic force that leaks out of the motor also changes, causing a further change in the output of the throttle sensor. As just described, the output of the throttle sensor is likely to change or vary under the influence of the magnetic force leaking out of the motor. As a result, the throttle sensor could not accurately detect the opening degree of the throttle valve. This makes it difficult to control the amount of intake air with accuracy.

BRIEF SUMMARY OF THE INVENTION

The present invention has an object to provide an electrically controlled throttle apparatus that comprises a throttle sensor adapted to be less influenced by a magnetic force leaking out of a motor and accordingly to enhance detection accuracy for an opening degree of a throttle valve.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an electrically controlled throttle apparatus, comprising: a throttle valve for controlling an amount of intake air to be supplied to an internal combustion engine; a throttle body which houses the throttle valve; a motor for driving the throttle valve; and a throttle sensor for detecting an opening degree of the throttle valve, wherein the throttle sensor is a magnetic resistance element for detecting a change in direction of a magnetic field, and the direction of the magnetic field to be detected by the magnetic resistance element for detecting the opening degree of the throttle valve in an opening learning reference position is the same as a direction of a leakage magnetic field from the motor.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

Figure 1:
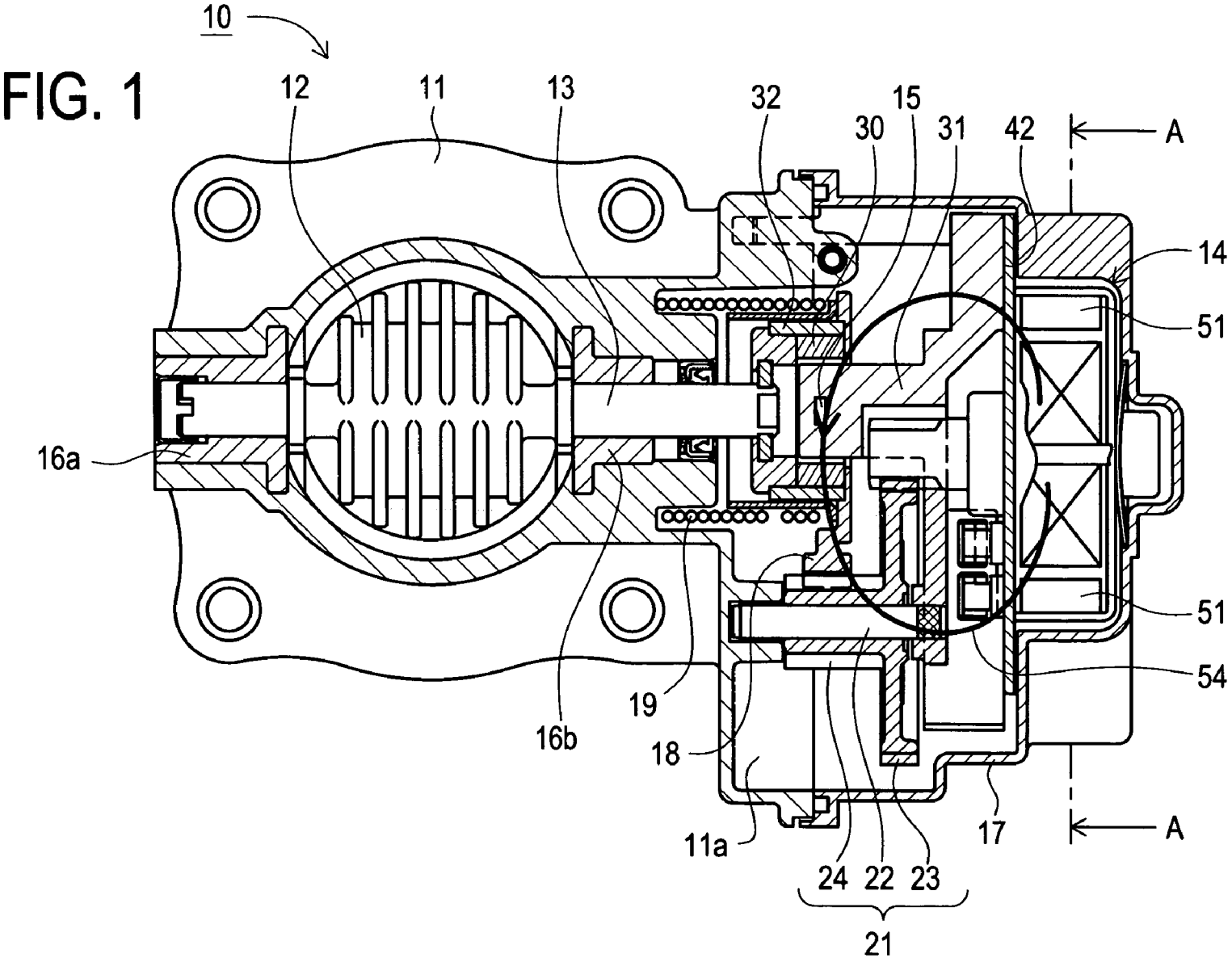
FIG. 1 is a sectional view of an electrically controlled throttle apparatus of an embodiment.
Figure 2:
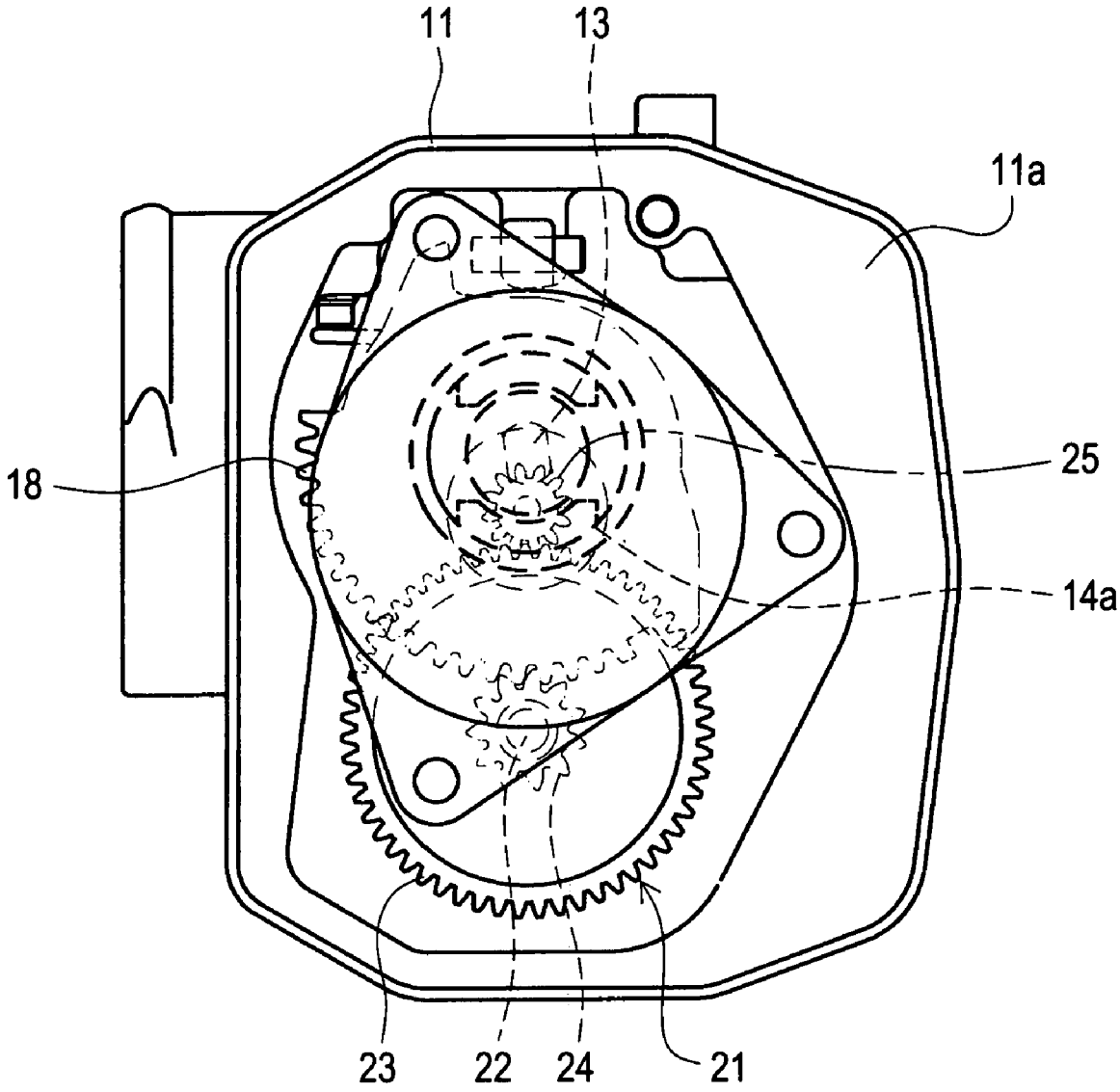
FIG. 2 is a right side view of the electrically controlled throttle apparatus of FIG. 1 with a cover detached therefrom.
Figure 3:
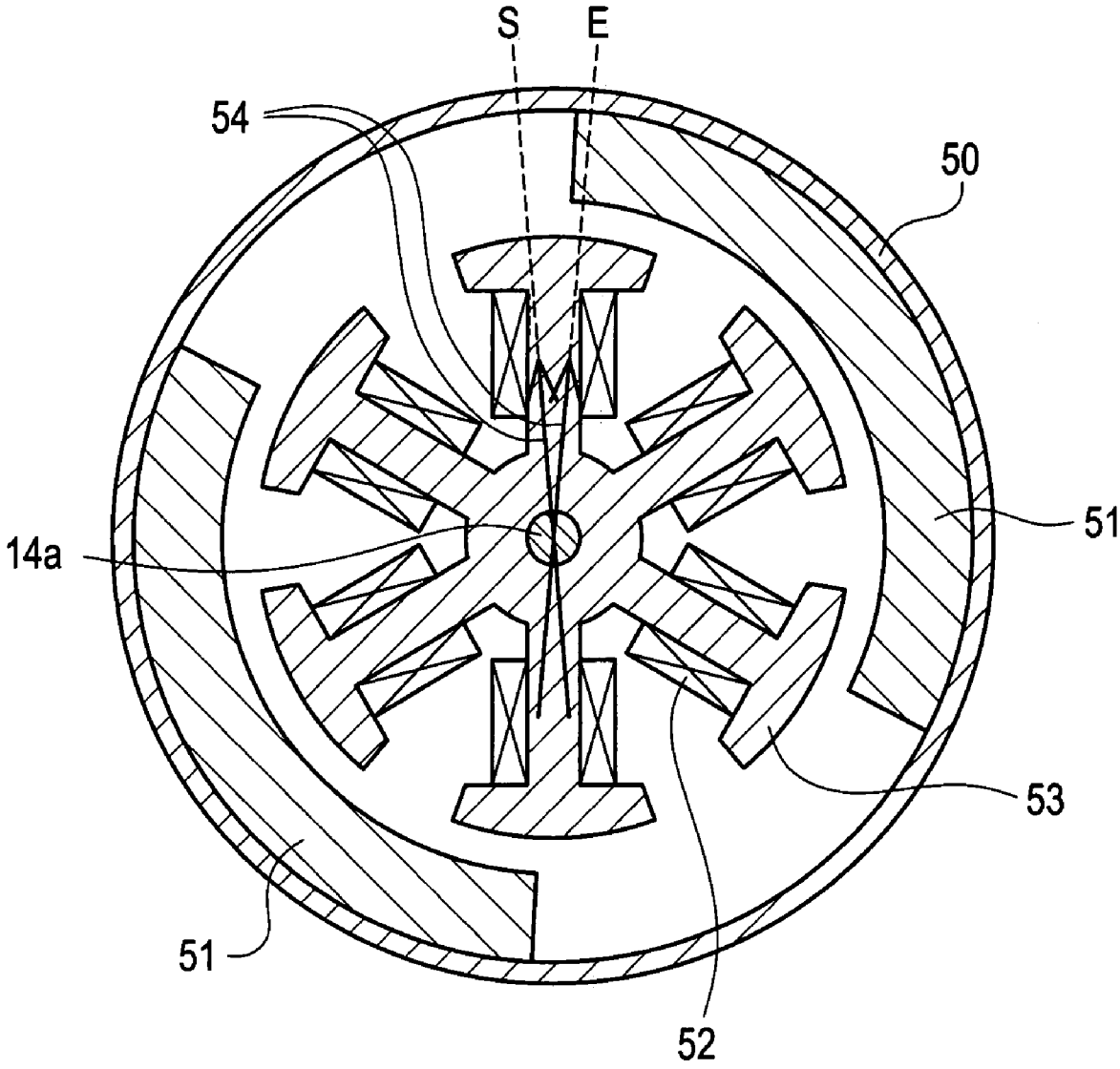
FIG. 3 is a sectional view of a motor taken along a line A-A in FIG. 1.
Figure 4:
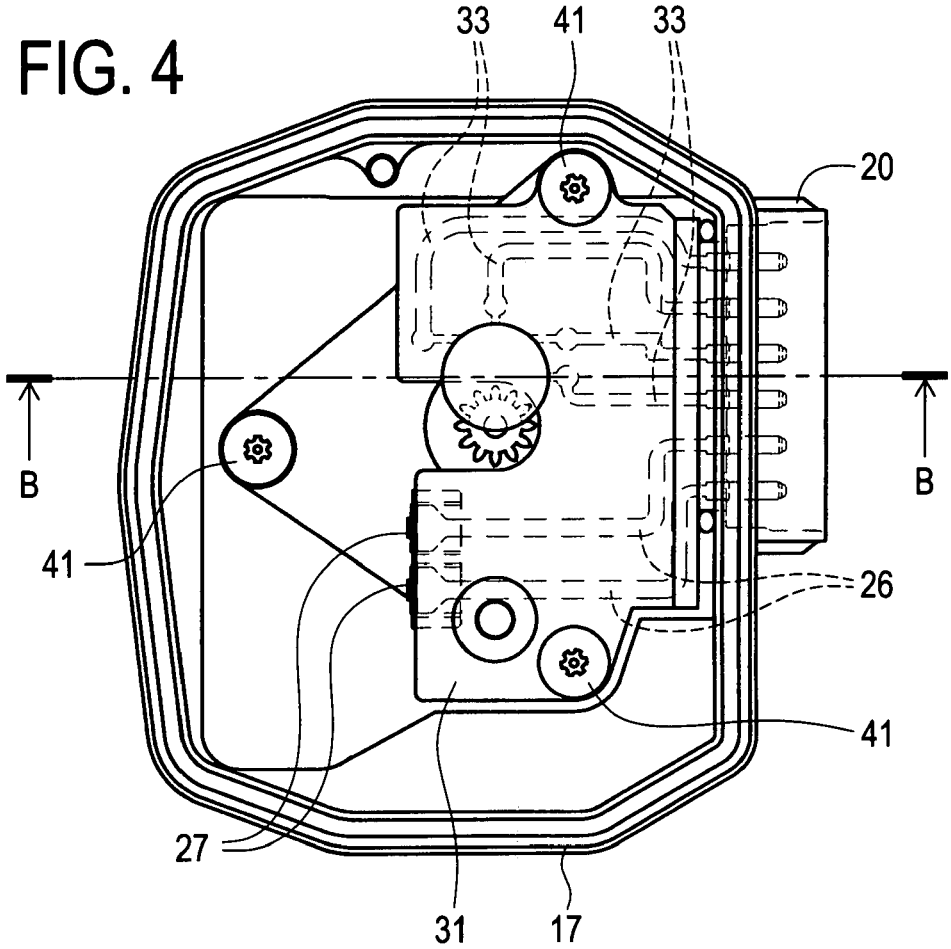
FIG. 4 is a view showing electric wiring embedded in a sensor cover, which are connected to a motor and a throttle sensor.
Figure 5:
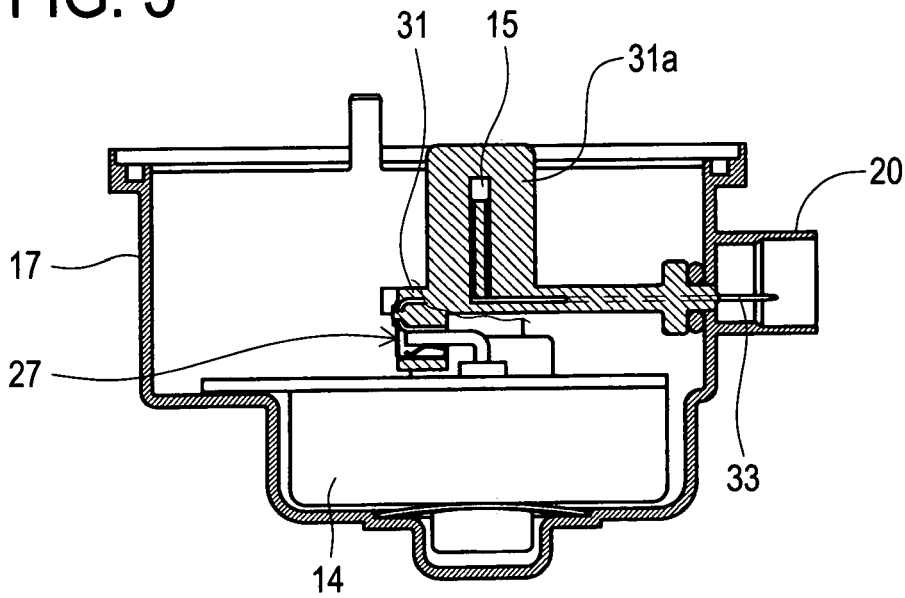
FIG. 5 is a sectional view taken along a line B-B in FIG. 4.
Figure 6:
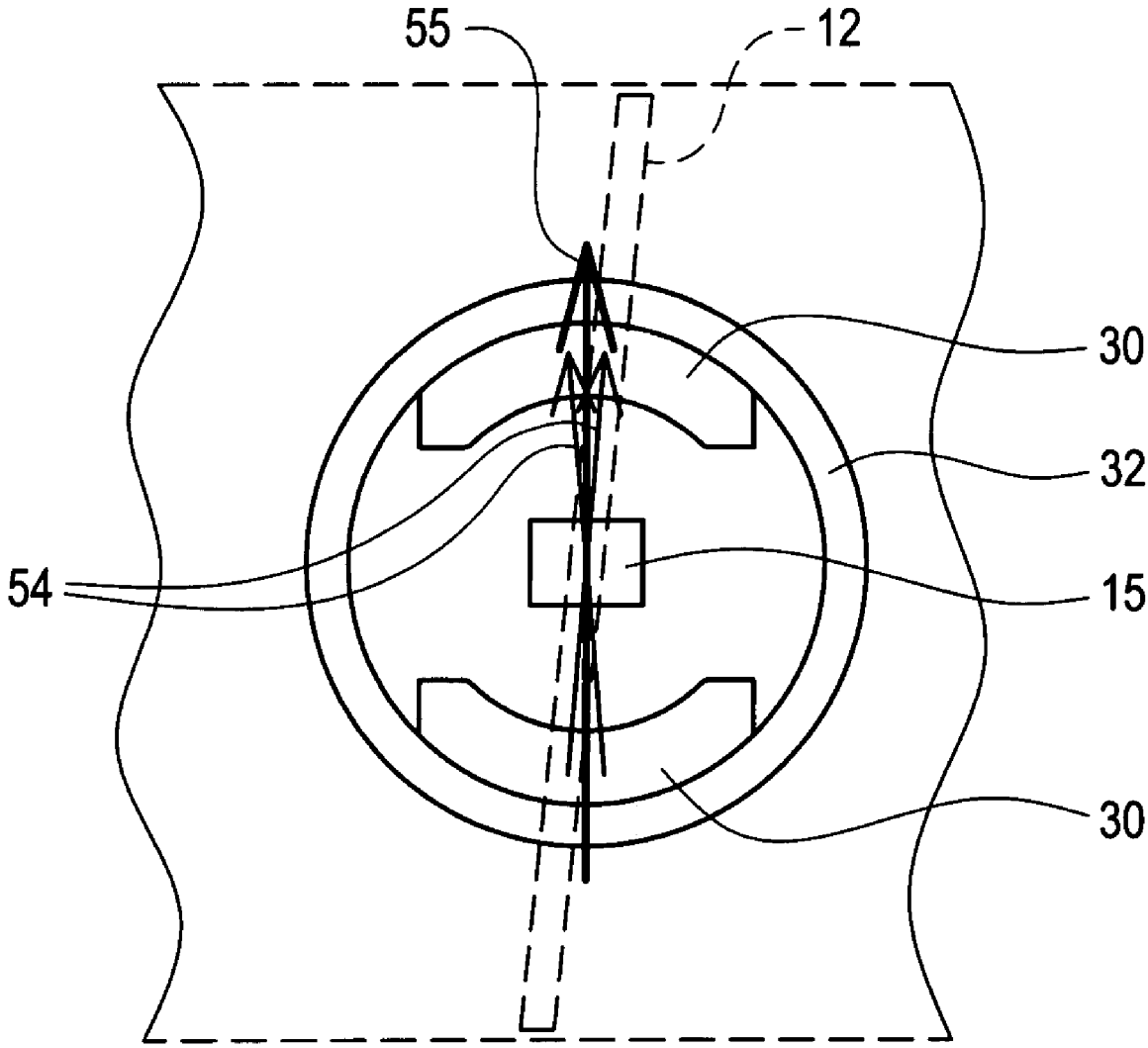
FIG. 6 is an explanatory view for explaining a direction of a measured magnetic field by the throttle sensor.

A detailed description of a preferred embodiment of an electrically controlled throttle apparatus embodying the present invention will now be given referring to the accompanying drawings. This electrically controlled throttle apparatus of the present embodiment will be described referring to FIGS. 1 to 6. FIG. 1 a sectional view of the electrically controlled throttle apparatus of the present embodiment. FIG. 2 is a right side view of the electrically controlled throttle apparatus of FIG. 1 with a cover detached therefrom. FIG. 3 is a sectional view of a motor taken along a line A-A in FIG. 1. FIG. 4 is a view showing electric wiring embedded in a sensor cover and connected to the motor and a throttle sensor respectively. FIG. 5 is a sectional view taken along a line B-B in FIG. 4. FIG. 6 is an explanatory view for explaining a direction of a measured magnetic field by the throttle sensor.

Figure 7:
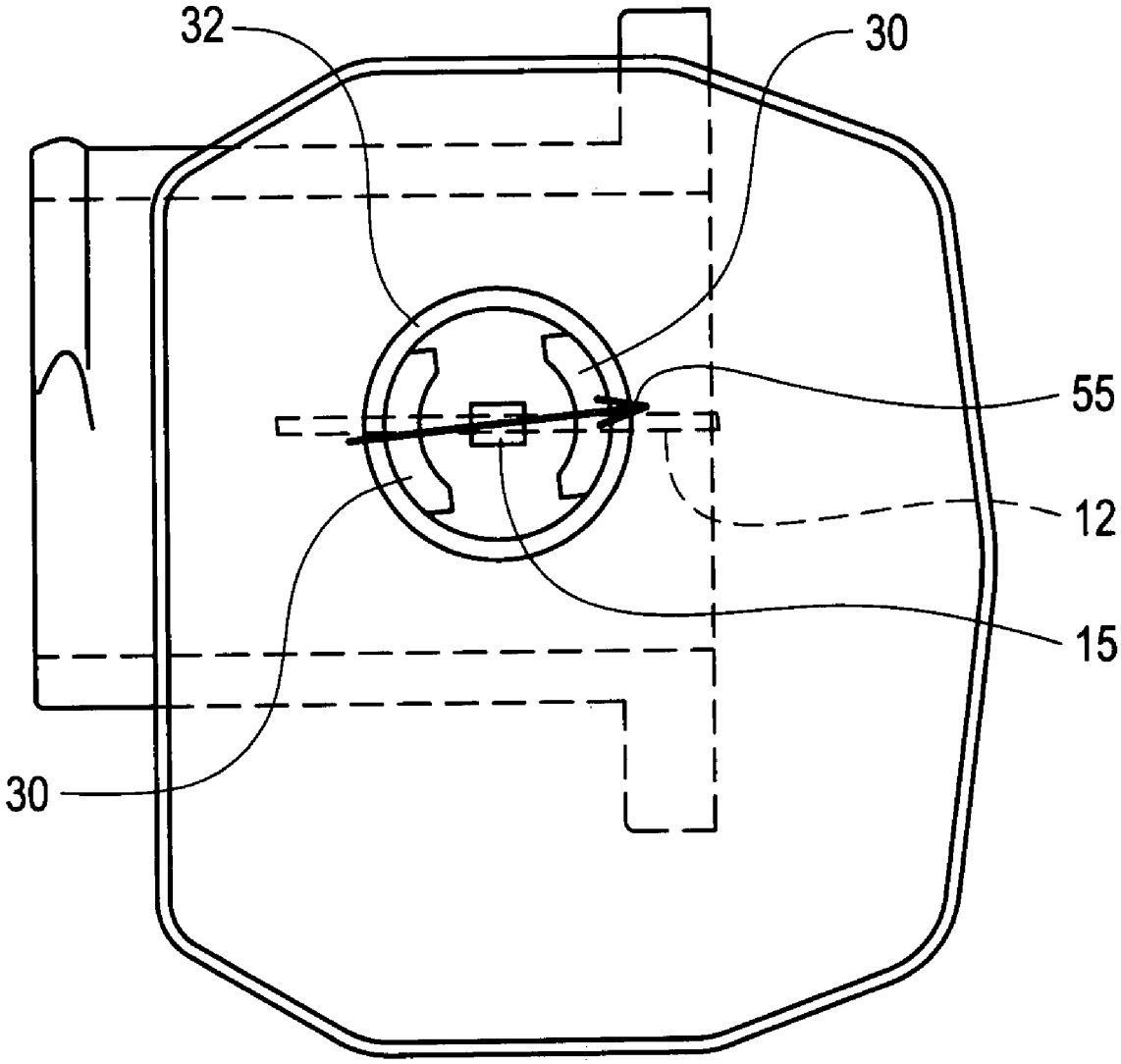
FIG. 7 is an explanatory view for explaining that the direction of the measured magnetic field by the throttle sensor will change in association with opening/closing of the throttle valve.

FIG. 7 is an explanatory view for explaining that the direction of the measured magnetic field by the throttle sensor will change in association with opening/closing of the throttle valve.

The electrically controlled throttle apparatus 10 of the present embodiment comprises, as shown in FIG. 1, a throttle body 11 forming an intake passage which will be connected to an engine, a throttle valve 12 rotatably supported in this throttle body 11, and a motor 14 for driving (opening/closing) the throttle valve 12. The throttle body 11 is fixed to an intake manifold of the engine with a fastening member such as a bolt. When mounted in a vehicle, the electrically controlled throttle apparatus 10 is operated to drive the motor 14, rotating the throttle valve 12 to open and close the intake passage, thereby controlling an amount of intake air to be supplied into the intake passage.

The throttle body 11 has a nearly cylindrical intake passage in which the throttle valve 12 is placed. This throttle body 11 is made of a resinous material for weight reduction.

In the above throttle body 11, both ends of a valve shaft 13 extending across the intake passage in its diametrical direction are rotatably supported by bearings 16*a* and 16*b*. Formed on the valve shaft 13 is the throttle valve 12 having an almost circular disc shape, which can rotate to open and close the intake passage. It should be noted that the throttle valve 12 is made of resin and integral with the valve shaft 13 by insert molding.

The throttle body 11 is formed, on its one side (a right side in FIG. 1), with a gear housing 11*a* in which a gear and others are housed. To an open end of the gear housing 11*a*, a resinous cover 17 is attached to close the opening. In the present embodiment, the cover 17 is adhered to the throttle body 11 with adhesion.

One end (a right end in FIG. 1) of the valve shaft 13, protruding into the gear housing 11*a*, is coupled with a throttle gear 18 made of resin by integral molding. Fixed to this throttle gear 18 is a coiled return spring 19 for urging the throttle valve 12 and the valve shaft 13 together in a full closing direction. On an inner circumferential surface of the throttle gear 18, furthermore, two permanent magnets 30 and 30 are fixed facing each other and a yoke 32 is placed around the permanent magnets 30 and 30.

In the gear housing 11*a*, as shown in FIG. 2, an intermediate reduction gear 21 which will rotate in engagement with the throttle gear 18 is placed. This intermediate gear 21 is made of resin by integral molding and fitted on and rotatably about a gear shaft 22 fixed to the throttle body 11. The intermediate gear 21 includes a large-diameter gear 23 at one end and a small-diameter gear 24 at the other end, which are made in integral form. This small-diameter gear 24 of the intermediate gear 21 engages with the throttle gear 18. On the other hand, the large-diameter gear 23 of the intermediate gear 21 engages with a motor gear 25 fixed on the output shaft 14*a* of the motor 14. The motor gear 25 is made of resin by integral molding.

The motor 14 is a well known brush DC motor, which has two circular-arc permanent magnets 51 and 51 arranged to face each other on an inner surface of a motor case 50 as shown in FIG. 3. Further, a stator 53 installed with coils 52 is placed between the permanent magnets 51 and 51. The output shaft 14*a* is fixed to the center of the stator 53. Energization of the coils 52 is controlled by brushes and a commutator, both not shown.

Energization of the motor (the brushes) is effected through two lead frames 26 and two motor contact terminals 27 all of which are provided, or embedded, in a sensor cover 31 as shown in FIGS. 4 and 5. Each lead frame 26 is made of electrically conductive metal sheet to electrically connect the motor 14 to an external power source. Each motor contact terminal 27 is connected with one end of each lead frame 26. It should be noted that the lead frames 26 are embedded in the sensor cover 31, but the motor contact terminals 27 are exposed from the sensor cover 31. The other end of each lead frame 26 is exposed in a connector 20 provided in the cover 17.

A throttle sensor 15 for detecting an opening degree of the throttle valve 12 is placed in the gear housing 11*a* of the throttle body 11 in such a manner as to face the valve shaft 13. Specifically, the throttle sensor 15 is located in a protruding portion 31*a* of the sensor cover 31. This throttle sensor 15 is a magnetic resistance element (MRE or GMR). As shown in FIGS. 5 and 6, the permanent magnets 30 and 30 are placed on an inner circumferential surface of the yoke 32 fixed to the throttle gear 18 that is rotatable in association with the rotation of the throttle valve 12 and the valve shaft 13. The throttle sensor 15 is placed midway between the permanent magnets 30 and 30 and coaxially with the valve shaft 13. As shown in FIG. 7, accordingly, the direction of a magnetic field (a measured magnetic field) 55 generated by the permanent magnets 30 and 30 will change according to the opening/closing of the throttle valve 12 (the rotation of the valve shaft 13). By detecting a change in the direction of the measured magnetic field 55, the throttle sensor 15 detects the opening degree of the throttle valve 12.

To the throttle sensor (the magnetic resistance element) 15, as shown in FIGS. 4 and 5, each end of four lead frames 33 is connected. Each lead frame 33 is made of electrically conductive metal sheet for electrically connecting to an external ECU. The lead frames 33 are embedded in the sensor cover 31 so that the other ends of the lead frames 33 are exposed in the connector 20.

The sensor cover 31 is secured to a metallic mounting flange 42 with three mounting screws 41 to combine with the motor 14 into one unit. This unit is then fixed to the cover 17.

Here, the energization of the motor 14 is started at a point S and terminated at a point E in FIG. 3. Accordingly, a leakage magnetic field 54 is generated from the motor 14 only in a direction within a range between the arrows (a direction within a specific range) as shown in FIG. 3. This leakage magnetic field 54 might act on the throttle sensor 15 as shown by an arrow in FIG. 1, which leads to deterioration in detection accuracy of the throttle sensor 15. In other words, under the influence of the leakage magnetic field 54 from the motor 14, the throttle sensor 15 could not detect a change in the direction of the measured magnetic field 55 with accuracy.

In the electrically controlled throttle apparatus 10, therefore, as shown in FIG. 6, the motor 14 is placed by adjusting the positions of the permanent magnets 30 and 30 and the positions of the permanent magnets 51 and 51 of the motor 14 so that the direction of the leakage magnetic field 54 from the motor 14 and the direction of the measured magnetic field 55 of the throttle sensor 15 are the same as each other when the throttle valve 12 is in the full closed position (the idling opening position) set as an opening learning reference position of the throttle valve 12. In the present embodiment, the permanent magnets 30 and 30 are first placed without adjustment on the inner circumferential surface of the throttle gear 18 in such a manner as to face each other, and the motor 14 is then mounted by adjusting the mounting position of the motor 14 relative to such permanent magnets 30 and 30 so as to establish the above positional relation.

In the electrically controlled throttle apparatus 10 configured as above, the direction of the measured magnetic field 55 of the throttle sensor 15 with respect to the throttle valve 12 in the full closed position is less influenced by the leakage magnetic field 54 from the motor 14.

Further, since the metallic mounting flange 42 exists between the motor 14 and the throttle sensor 15, this mounting flange 42 can act as a shielding member for shielding against the leakage magnetic field 54 from the motor 14. The throttle sensor 15 is therefore less influenced by the leakage magnetic field 54 from the motor 14.

In the electrically controlled throttle apparatus 10 configured as above, the motor 14 is externally energized from a state where the throttle valve 12 is fully closed, rotating the output shaft 14*a* and further rotating the motor gear 25. This rotation is decelerated through the intermediate reduction gear 21 and then transmitted to the throttle gear 18. This causes the valve shaft 13 and the throttle valve 12 to rotate against the urging force of the return spring 19, thereby opening the intake passage, that is, bringing the throttle valve 12 into an open state. When the throttle valve 12 is to be held at a predetermined opening degree, the motor 14 is controlled to generate turning torque, which is transmitted as a holding force to the valve shaft 13 and the throttle valve 12 through the motor gear 25, the intermediate reduction gear 21, and the throttle gear 18. When this holding force is balanced with the urging force of the return spring 19, the throttle valve 12 is held at the predetermined opening degree. By this adjustment of the opening degree of the throttle valve 12, the amount of intake air is controlled.

In the electrically controlled throttle apparatus 10 of the present embodiment, the full closed position of the throttle valve 12 (the idling opening position) serves as the opening learning reference position of the throttle valve 12 used as a criterion by the throttle sensor 15 and, as shown in FIG. 6, the direction of the leakage magnetic field 54 from the motor 14 and the direction of the measured magnetic field 55 of the throttle sensor 15 are the same as each other when the throttle valve 12 is in the full closed position.

Accordingly, when the throttle valve 12 is in the full closed position serving as the opening learning reference position used as a criterion by the throttle sensor 15, the throttle sensor 15 is less influenced by the leakage magnetic field 54 from the motor 14. This makes it possible to prevent the throttle sensor 15 from outputting an improper detection signal and thus provide improved detection accuracy. Consequently, the throttle sensor 15 can accurately detect the opening degree of the throttle valve 12, so that the amount of intake air can be controlled with high accuracy.

Here, in some engines such as a gasoline engine, using an ignition plug for igniting fuel, the amount of intake air will largely change with a change per unit angle of rotation of the throttle valve; in other words, the amount of intake air will largely change with a slight change in the opening degree when the throttle valve is in the full closed position (at the idling opening degree). To stabilize the idle speed, the throttle sensor is required to accurately detect the opening degree of the throttle valve.

The electrically controlled throttle apparatus 10 can detect the opening degree of the throttle valve 12 accurately (with high accuracy) when the throttle valve 12 is in the full closed position (at the idling opening degree). This makes it possible to control the amount of intake air with high accuracy and hence stabilize the idle speed.

According to the electrically controlled throttle apparatus 10 of the present embodiment, the motor 14 is placed by adjusting the positional relation between the permanent magnets 30 and 30 and the permanent magnets 51 and 51 of the motor 14 so that the direction of the leakage magnetic field 54 from the motor 14 and the direction of the measured magnetic field 55 of the throttle sensor 15 are the same as each other when the throttle valve 12 is in the full closed position (the idling opening position) serving as the opening learning reference position used as a criterion by the throttle sensor 15. When the throttle valve 12 is in the full closed position, accordingly, the throttle sensor 15 is less influenced by the leakage magnetic field 54 from the motor 14 and therefore the throttle sensor 15 can provide improved detection accuracy without causing any improper change in output. As a result, the amount of intake air can be controlled with high accuracy to stabilize the idle speed.

In the aforementioned embodiment, the direction of the leakage magnetic field 54 from the motor 14 and the direction of the measured magnetic field 55 of the throttle sensor 15 are the same as each other when the throttle valve 12 is in the full closed position (at the idling opening position). However, in some engine systems arranged to ignite fuel by use of an ignition plug, the opening learning reference position of the throttle sensor is set to the opener opening degree (the opening degree of the throttle valve 12 held when energization of the motor is off).

Figure 8:
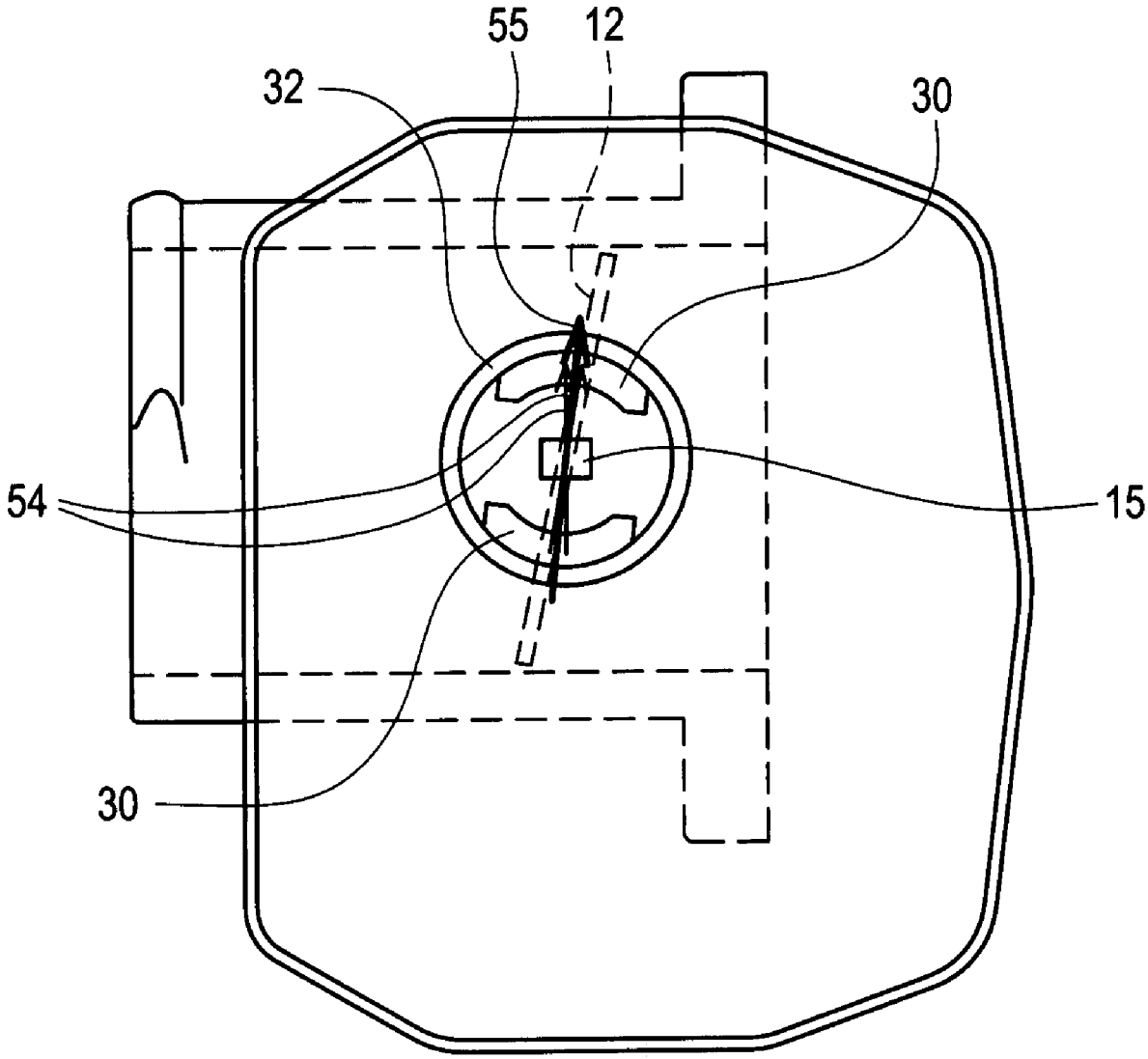
FIG. 8 is a view showing a state where a direction of a magnetic field from the motor and a direction of a measured magnetic field by the throttle sensor are the same as each other by adjusting a positional relation between permanent magnets placed around the sensor and permanent magnets placed in the motor when the throttle valve is in the opener opening position.

In such a case, the motor 14 is preferably disposed by adjusting the positional relation between the permanent magnets 30 and 30 and the permanent magnets 51 and 51 of the motor 14 as shown in FIG. 8 so that the direction of the leakage magnetic field 54 from the motor 14 and the measured magnetic field 55 of the throttle sensor 15 are the same as each other when the throttle valve 12 is in the opener opening degree. Since the throttle sensor 15 is less influenced by the leakage magnetic field 54 from the motor 14 when the throttle valve 12 is in the opening learning reference position, it is possible to prevent the throttle sensor 15 from outputting an improper detection signal and thus provide improved detection accuracy. FIG. 8 is a view showing a state where the direction of the leakage magnetic field 54 from the motor 14 and the direction of the measured magnetic field of the throttle sensor 15 are the same as each other by adjusting the positional relation between the permanent magnets 30, 30 around the sensor and the permanent magnets 51, 51 of the motor when the throttle valve 12 is in the opener opening position.

Some diesel engines using no ignition plug to ignite fuel are configured such that the opening learning reference position of the throttle sensor is set to a full open position of the throttle valve. In this case, the throttle sensor is required to accurately detect the opening degree of the throttle valve 12 in the full open position.

Figure 9:
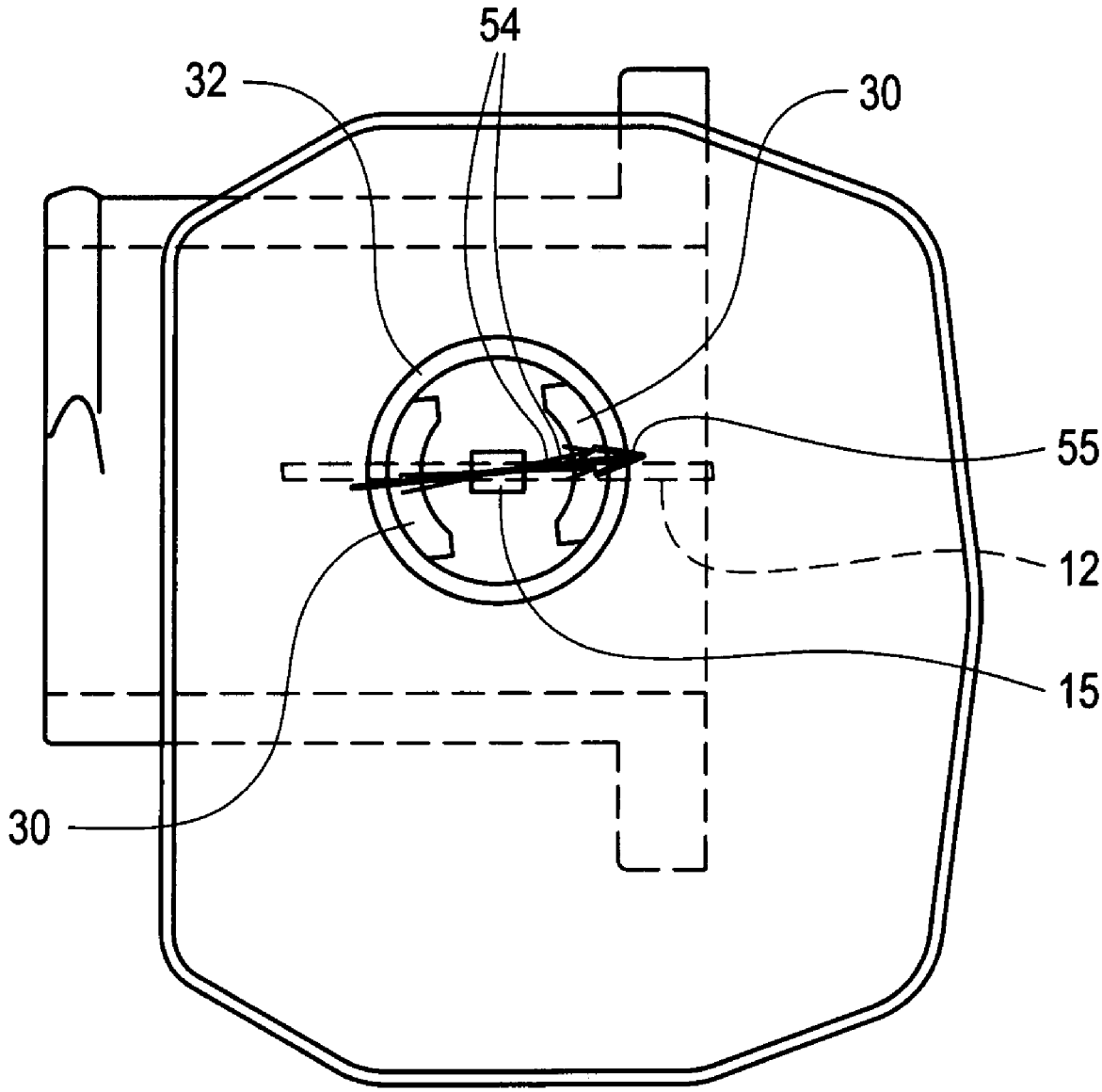
FIG. 9 is a view showing a state where a direction of a magnetic field from the motor and a direction of a measured magnetic field by the throttle sensor are the same as each other by adjusting a positional relation between permanent magnets placed around the sensor and permanent magnets placed in the motor when the throttle valve is in the full open position.

In the electrically controlled throttle apparatus to be mounted on such diesel engine, therefore, it is preferable to dispose the motor 14 by adjusting the positional relation between the permanent magnets 30, 30 and the permanent magnets 51, 51 of the motor 14 so that the direction of the leakage magnetic field 54 from the motor 14 is the same as the direction of the measured magnetic field 55 of the throttle sensor 15 as shown in FIG. 9. Since the throttle sensor 15 is less influenced by the leakage magnetic field 54 from the motor 14 when the throttle valve 12 is in the full open position set as the opening learning reference position, it is possible to prevent the throttle sensor 15 from outputting an improper detection signal and thus provide improved detection accuracy. Accordingly, the throttle sensor 15 can detect the opening degree of the throttle valve 12 accurately. FIG. 9 is a view showing a state where the direction of the magnetic field 54 from the motor 14 and the direction of the measured magnetic field 55 of the throttle sensor 15 are the same as each other by adjusting the positional relation between the permanent magnets around the sensor 15 and the permanent magnets in the motor 14 when the throttle valve 12 is in the full open position.

The present invention may be embodied in other specific forms without departing from the essential characteristics thereof. For instance, in the above embodiment, the electrically controlled throttle apparatus with the motor placed in the cover is exemplified. However, the placement of the motor is not limited thereto. The present invention may also be applied to any electrically controlled throttle apparatuses configured such that a motor is placed in parallel with a valve shaft in a throttle body. This configuration can also provide the same operations and effects as above.

The throttle body in the above embodiment is made of resin, but it may be made of aluminum die-cast.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An electrically controlled throttle apparatus, comprising:

a throttle valve for controlling an amount of intake air to be supplied to an internal combustion engine;

a throttle body which houses the throttle valve;

a motor for driving the throttle valve; and a throttle sensor for detecting an opening degree of the throttle valve, wherein the throttle sensor is a magnetic resistance element for detecting a change in direction of a magnetic field, and the direction of the magnetic field to be detected by the magnetic resistance element for detecting the opening degree of the throttle valve in an opening learning reference position is the same as a direction of a leakage magnetic field from the motor.

2. The electrically controlled throttle apparatus according to claim 1, wherein the opening learning reference position is an opening degree position at which the throttle valve is fully closed.

3. The electrically controlled throttle apparatus according to claim 2, wherein the opening degree at which the throttle valve is fully closed is an idling opening which is an opening degree of the throttle valve during an idling operation of the internal combustion engine.

4. The electrically controlled throttle apparatus according to claim 1, wherein the opening learning reference position corresponds to an opener opening degree which is an opening degree of the throttle valve held when energization of the motor is off.

5. The electrically controlled throttle apparatus according to claim 1, wherein the opening learning reference position is an opening degree at which the throttle valve is fully open.

6. The electrically controlled throttle apparatus according to claim 5 can be mounted in a diesel engine.

7. The electrically controlled throttle apparatus according to claim 1, wherein the motor is a brush DC motor including two magnets placed facing each other.

8. The electrically controlled throttle apparatus according to claim 7, further comprising a shielding member for shielding against a magnetic field, the shielding member being placed between the magnets and the magnetic resistance element.

9. The electrically controlled throttle apparatus according to claim 8, wherein the shielding member is a metallic mounting flange to which a cover in which the throttle sensor is placed is attached.

* * * * *